US007670741B2

(12) United States Patent
Yamada et al.

(10) Patent No.: US 7,670,741 B2
(45) Date of Patent: Mar. 2, 2010

(54) TONER

(75) Inventors: Masahide Yamada, Numazu (JP); Akinori Saitoh, Numazu (JP); Masahiro Ohki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 312 days.

(21) Appl. No.: 11/687,075

(22) Filed: Mar. 16, 2007

(65) Prior Publication Data

US 2007/0218391 A1 Sep. 20, 2007

(30) Foreign Application Priority Data

Mar. 17, 2006 (JP) ..... 2006-075645

(51) Int. Cl.
*G03G 9/087* (2006.01)

(52) U.S. Cl. ..... 430/109.4; 430/137.15

(58) Field of Classification Search ..... 430/109.4, 430/137.15

See application file for complete search history.

(56) References Cited

U.S. PATENT DOCUMENTS

| | | | | |
|---|---|---|---|---|
| 6,660,443 | B2 * | 12/2003 | Sugiyama et al. | 430/108.4 |
| 6,740,460 | B2 * | 5/2004 | Tomita et al. | 430/109.4 |
| 7,449,273 | B2 * | 11/2008 | Ohki et al. | 430/108.3 |
| 2003/0207961 | A1 * | 11/2003 | Batlaw | 523/160 |
| 2004/0053155 | A1 | 3/2004 | Emoto et al. | |
| 2004/0265721 | A1 | 12/2004 | Matsuoka et al. | |
| 2005/0008961 | A1 | 1/2005 | Takada et al. | |
| 2005/0031980 | A1 | 2/2005 | Inoue et al. | |
| 2005/0042534 | A1 | 2/2005 | Tanaka et al. | |
| 2005/0164112 | A1 | 7/2005 | Ohki et al. | |
| 2006/0046174 | A1 | 3/2006 | Ohki et al. | |
| 2006/0057488 | A1 | 3/2006 | Inoue et al. | |
| 2006/0063089 | A1 | 3/2006 | Tanaka et al. | |
| 2006/0068312 | A1 | 3/2006 | Yamashita et al. | |
| 2006/0099529 | A1 | 5/2006 | Tanaka et al. | |
| 2006/0160011 | A1 | 7/2006 | Inoue et al. | |
| 2006/0210903 | A1 | 9/2006 | Ohki et al. | |
| 2006/0251979 | A1 | 11/2006 | Watanabe et al. | |

FOREIGN PATENT DOCUMENTS

| | | |
|---|---|---|
| EP | 0 302 939 | 2/1989 |
| EP | 1 530 100 A1 | 5/2005 |
| EP | 1 617 294 A2 | 1/2006 |
| JP | 62-063940 | 3/1987 |
| JP | 09-034167 | 2/1997 |
| JP | 2931899 | 5/1999 |
| JP | 11-149180 | 6/1999 |
| JP | 2003-255606 | 9/2003 |
| JP | 2004-124059 | 4/2004 |

OTHER PUBLICATIONS

U.S. Appl. No. 12/026,937, filed Feb. 6, 2008, Seshita, et al.
U.S. Appl. No. 12/040,451, filed Feb. 29, 2008, Saitoh, et al.
U.S. Appl. No. 12/042,041, filed Mar. 4, 2008, Yamada, et al.
U.S. Appl. No. 11/670,874, filed Feb. 2, 2007, Inoue, et al.
U.S. Appl. No. 12/203,278, filed Sep. 3, 2008, Yamada, et al.
U.S. Appl. No. 11/855,806, filed Sep. 14, 2007, Awamura, et al.
U.S. Appl. No. 11/856,379, filed Sep. 17, 2007, Sawada, et al.

* cited by examiner

*Primary Examiner*—John L Goodrow
(74) *Attorney, Agent, or Firm*—Oblon, Spivak, McClelland, Maier & Neustadt, L.L.P.

(57) ABSTRACT

A toner containing a toner particle manufactured by dispersing an organic solvent in which a component comprising a polymer having a portion reactive with an active hydrogen group is dispersed or dissolved in an aqueous medium; and reacting the polymer with a compound having at least one active hydrogen group, where the polymer is prepared by reacting an aliphatic polyol, a polyester resin and a diisocyanate compound and has an isocyanate group on at least one end of the polymer.

11 Claims, No Drawings

TONER

BACKGROUND OF THE INVENTION

1. Field of the Invention

The present invention relates to a toner.

2. Discussion of the Background

Image formation by electrophotography is typically performed including the following processes:

(1) A latent electrostatic image formed on an image bearing member, for example, photoreceptors, is developed with a developing agent including a toner to form a toner image on the image bearing member (developing process);

(2) the toner image is transferred on a receiving material, for example, receiving paper, optionally via an intermediate transfer medium (transfer process); and (3) the toner image is fixed on the receiving material upon application of heat, pressure, solvent vapor or the like (fixing process).

Developing a latent electrostatic image is typified into a liquid development method using a liquid developing agent in which various kinds of pigments and/or dyes are dispersed in insulative organic liquid and a dry development method, for example, a cascade method, a magnetic brush method and a powder crowd method, using a dry developing agent (hereinafter referred to as toner) in which a coloring agent, for example, carbon black, is dispersed in a natural or synthetic resin. In recent years, a dry development method has been diffused.

As a prevalent fixing method for use in the dry development method, a heat roller system is widely used in terms of its energy efficiency. To save energy by fixing toner at a low temperature, the thermal energy given during fixing is currently decreasing. In the Demand-side Management (DSM) program announced in 1999 by International Energy Agency (IEA), there is a technology procurement project for the next generation photocopier. In the requisite, drastic progress on saving energy is required such that, for a photocopier of 30 or higher cpm, the time taken to be ready recovering from stand-by status is within 10 seconds and the power consumption is from 10 to 30 W, depending on the copying speed, during stand-by status. A method of improving the temperature response of toner is conceivable to address the requisite but is not sufficient to obtain a good result.

To clear such requisites and minimize the stand-by time, technology speaking, it seems inevitable to lower the fixing temperature of toner so that the toner fixing temperature during operation is lowered.

To respond to the movement for this low temperature fixing, polyester resins, which have a relatively good low temperature fixing property and a good heat resistance preservation property, have been tried instead of using typically used styrene-acryl resins. In addition, there are other technologies, for example, published unexamined Japanese patent application No. (hereinafter referred to as JOP) S62-63940 describing adding a specific non-olefin crystalline polymer to a binder to improve the low temperature fixing property, and Japanese patent No. (hereinafter referred to as JP) 2931899 describing using crystalline polyester. However, it is difficult to say that the molecular structure and the molecular weight are not optimized therein.

Furthermore, it is impossible to achieve the goal of the DSM program by an application of these known technologies. Thus, it is desired to establish a relatively advanced technology for the improvement on the lower temperature fixing property of toner in comparison with the known technologies.

To further improve the lower temperature fixing property, there is a way of controlling the thermal characteristics of a resin. However, a glass transition temperature (Tg) of a resin that is excessively low causes deterioration of heat resistance preservation property thereof. Also a small molecular weight of a resin that invites too low an F1/2 temperature causes problems such that hot offset occurs at a low temperature. Resultantly, a toner having a good combination in terms of a low temperature fixing and a hot offset temperature has not been obtained by controlling the thermal characteristics of a resin.

With regard to methods of manufacturing a toner for use in developing latent electrostatic image, these methods are classified into pulverization methods and polymerization methods. In pulverization methods, toner is manufactured by uniformly dispersing a colorant, a charge controlling agent, an offset preventing agent, etc., in a thermoplastic resin through fusion mixing followed by pulverization and classification of the resultant. A good product of toner can be obtained by such a pulverization method but selection of materials for the toner is limited. For example, the composition obtained through fusion melting is desired to be pulverized and classified by a device available with a reasonable cost. Considering this point, the obtained composition through fusion melting is desired to be sufficiently brittle. When such a brittle composition is pulverized, obtained particles tend to have a wide particle size distribution. To produce images having a good definition and a good gradation, it is desired to remove fine particle having, for example, a weight average particle diameter of, for example, 4 μm or less and coarse particles having, for example, a weight average particle diameter of, for example, 15 μm or more. This may result in excessively low yield of toner. Also, it is difficult to uniformly disperse agents, for example, a colorant and a charge controlling agent, in a thermoplastic resin. Such non-uniform dispersion has an adverse impact on the fluidity, developability, durability, image quality, etc. of the resultant toner.

To address these drawbacks of the pulverization method, suspension polymerization methods have been proposed and performed in recent years. Manufacturing toner for use in developing latent electrostatic image by a polymerization method is already known to public. Toner particles are obtained by, for example, a suspension polymerization method or an emulsification polymerization method described in, for example, JP 2634503.

However, in these manufacturing methods, it is impossible to manufacture toner from polyester resins, which has an advantage in terms of the low temperature fixing property. To solve this drawback, for example, JOP H09-34167 describes a technology in which a polyester resin toner is made to have a spherical form by using a solvent in an aqueous medium and JOP H11-149180 describes a technology of obtaining a toner through an isocyanate reaction. However, these technologies are not satisfactory in terms of the low temperature fixing property and the productivity of toner.

SUMMARY OF THE INVENTION

Because of these reasons, the present inventors recognize that a need exists for a toner having a good combination of low temperature fixing property, anti-offset property and charging property.

Accordingly, an object of the present invention is to provide a toner having a good combination of low temperature fixing property, anti-offset property and charging property to produce quality images.

Briefly this object and other objects of the present invention as hereinafter described will become more readily apparent and can be attained, either individually or in combination thereof, by a toner manufactured by a method including: dispersing an organic solvent comprising a polymer having a portion reactive with an active hydrogen group in an aqueous medium; and reacting the polymer with a compound having at least one active hydrogen group, wherein the polymer is prepared by reacting an aliphatic polyol, a polyester resin and a diisocyanate compound and has an isocyanate group on at least one end of the polymer. While this method can be used in the preparation of mother particles that can be used as a toner per se, the thus prepared toner mother particles can be mixed with other particles of, for example, release agents, charge controlling agents, fluidizing agents and colorants.

It is preferred that, in the toner mentioned above, the number of carbon atoms in the main chain of the aliphatic polyols is from 3 to 10.

It is still further preferred that, in the toner mentioned above, the hydroxyl group values of the mixture of the aliphatic polyol and the polyester resin is from 15 to 30 mgKOH/g.

It is still further preferred that the toner mentioned above has a weight average particle diameter of from 3 to 8 μm.

It is still further preferred that the toner mentioned above has a ratio of the weight average particle diameter to the number average particle diameter is from 1.00 to 1.25.

It is still further preferred that the toner mentioned above has an average circularity of from 0.90 to 1.00.

It is still further preferred that the toner mentioned above has an acid value of from 1 to 30 mgKOH/g.

These and other objects, features and advantages of the present invention will become apparent upon consideration of the following description of the preferred embodiments of the present invention.

DETAILED DESCRIPTION OF THE INVENTION

The present invention will be described below in detail with reference to several embodiments.

The toner of the present invention is obtained by dispersing a solution or a liquid dispersion in which a composition containing a polymer having a portion reactionable with an active hydrogen group is dissolved or dispersed in an organic solvent in an aqueous medium followed by a reaction between active hydrogen groups and the polymer. The polymer (hereinafter referred to as a prepolymer) having a portion reactionable with an active hydrogen group is obtained by reacting an aliphatic polyol, a polyester resin and a diisocyanate compound and has an isocyanate group at its end. Also, the toner composition can further contain a colorant and a releasing agent. The toner is obtained by removing the organic solvent followed by washing and drying during or after the reaction of the prepolymer and active hydrogen groups. It is found that the resultant toner has a good combination of low temperature fixing property, anti-offset property and preservability.

A preferred aspect of the invention is a toner comprising a toner particle manufactured by a method comprising:

dispersing an organic solvent in which a component comprising a polymer having a portion reactive with an active hydrogen group is dispersed or dissolved in an aqueous medium; and reacting the polymer with a compound having at least one active hydrogen group, wherein the polymer is prepared by reacting an aliphatic polyol, a polyester resin and a diisocyanate compound and has an isocyanate group on at least one end of the polymer.

In the present invention, specific examples of the active hydrogen group reacting with the prepolymer include hydroxyl group and amino group, which is preferred.

Specific examples of the alcohol component in the polyester resin include diol and tri- or higher polyols. Among them, diol alone or with a small amount of triol is preferred.

Specific examples of the diols include alkylene glycol, alkylene ether glycols, alicyclic diols, adducts of the alicyclic diols with an alkylene oxide, bisphenols and adducts of the bisphenols with an alkylene oxide.

Suitably preferred alkylene glycols have 2 to 12 carbon atoms and their specific examples include ethylene glycol, 1,2-propylene glycol, 1,3-propylene glycol, 1,4-butanediol and 1,6-hexanediol. Specific examples of the alkylene ether glycols include diethylene glycol, triethylene glycol, dipropylene glycol, polyethylene glycol, polypropylene glycol and polytetramethylene ether glycol. Specific examples of the alicyclic diols include 1,4-cyclohexane dimethanol and hydrogenated bisphenol A. Specific examples of the adducts of the alicyclic diols with an alkylene oxide include compounds in which an alkylene oxide, for example, ethylene oxide, propylene oxide and butylene oxide, is adducted to the alicyclic diols mentioned above. Specific examples of the bisphenols include bisphenol A, bisphenol F and bisphenol S. Specific examples of the adducts of the bisphenols with an alkylene oxide include compounds in which an alkylene oxide, for example, ethylene oxide, propylene oxide and butylene oxide, is adducted to the bisphenols mentioned above.

Among these compounds, alkylene glycols having from 2 to 12 carbon atoms and adducts of a bisphenol with an alkylene oxide are preferred. Alkylene glycols having from 2 to 12 carbon atoms are particularly preferred.

Suitably preferred polyols having three or more hydroxyl groups have three to eight hydroxyl groups. Specific examples thereof include aliphatic alcohols having three or more hydroxyl groups, polyphenols having three or more hydroxyl groups and adducts of the polyphenol with an alkylene oxide.

Specific examples of the aliphatic alcohols having three or more hydroxyl groups include glycerin, trimethylol ethane, trimethylol propane, pentaerythritol and sorbitol. Specific examples of the polyphenols having three or more hydroxyl groups include trisphenol PA, phenol novolak and cresol novolak.

Specific examples of the carboxylic component in the polyester resin include dicarboxylic acid or tri- or higher polycarboxylic acid. Among them, dicarboxylic acid alone or with a small amount of tricarboxylic is preferred.

Specific examples of the dicarboxylic acids include alkylene dicarboxylic acids, alkenylene dicarboxylic acids, and aromatic dicarboxylic acids.

Specific examples of the alkylene dicarboxylic acids include succinic acid, adipic acid and sebacic acid. The alkenylene dicarboxylic acids preferably have 4 to 20 carbon atoms and specific examples thereof include maleic acid and fumaric acid. The aromatic dicarboxylic acids preferably have 4 to 20 carbon atoms and specific examples thereof include phthalic acid, isophthalic acid, terephthalic acid and naphthalene dicarboxylic acids. Suitably preferred tri- or higher polycarboxylic acids include an aromatic polycarboxylic acid having 9 to 20 carbon atoms. Specific examples thereof include trimellitic acid and pyromellitic acid. The carboxylic acid can be obtained by reacting a polyol with an acid anhydrate or a lower alkyl ester, for example, methyl ester, ethyl ester and isopropyl ester, of the carboxylic acid mentioned above.

When the alcohol and the polycarboxylic acid are subject to polycondensation, the mixing ratio of the alcohol to the carboxylic acid as the equivalence ratio ([OH]/[COOH]) of hydroxyl group [OH] to carboxyl group [COOH] is preferably from 1 to 2, more preferably from 1 to 1.5 and particularly preferably from 1.02 to 1.3.

The hydroxyl value of the polyester resin is preferably from 14 to 26 mgKOH/g and further preferably from 14 to 19 mgKOH/g.

Specific preferred examples of the diisocyanate include aliphatic polydiisocyanates (e.g., tetramethylene diisocyanate, hexamethylene diisocyanate and 2,6-diisocyanate methylcaproate); alicyclic diisocyanates (e.g., isophorone diisocyanate and cyclohexyl methane diisocyanate); aromatic diisocyanates (e.g., tolylene diisocyanate and diphenylmethane diisocyanate); aromatic aliphatic diisocyanates (e.g., $\alpha,\alpha,\alpha',\alpha'$-tetramethyl xylylene diisocyanate); isocyanurates; and blocked diisocyanates in which the diisocyanates mentioned above are blocked with phenol derivatives, oximes or caprolactams. These compounds can be used alone or in combination.

The aliphatic polyol represents aliphatic alcohols having three or more hydroxyl groups, among which aliphatic triols are preferred. The number of carbon atoms in the main chain is preferably from 3 to 10. Preferred specific examples thereof include trimethylol propane and pentaerythritol.

In the present invention, the hydroxyl value of a mixture of a polyester resin and an aliphatic polyol is preferably from 15 to 30 mgKOH/g, more preferably from 10 to 20 mgKOH/g and particularly preferably from 12 to 18 mg KOH/g. A hydroxyl value that is too small may degrade the temporal stability of a prepolymer when the prepolymer is made. A hydroxyl value that is too high may degrade the low temperature fixing property.

When a prepolymer having an isocyanate group at its end is synthesized, the equivalent ratio ([NCO]/[OH]) of the isocyanate group [NCO] to the hydroxyl group [OH] is from 2 to 4 and preferably from 2.1 to 2.5.

In the present invention, the acid value of a binding resin is preferably from 1 to 50 mgKOH/g.

Thereby, it is possible to improve the characteristics, for example, the low temperature fixing property, the anti-hot offset property, the heat resistance preservation property and the charging stability, of a toner. An excessively high acid value tends to cause insufficient elongation and/or cross-linking reaction of a prepolymer, which leads to deterioration of the anti-offset property. An excessively low acid value tends to accelerate the elongation and/or cross-linking reaction, which causes a problem in terms of manufacturing stability.

The glass transition temperature of a toner, on which the heat resistance preservation property thereof depends, is preferably from 40 to 70° C. When the glass transition temperature is too low, the heat resistance preservation property may deteriorate. When the glass transition temperature is too high, the low temperature fixing property may deteriorate.

The toner of the present invention has a specific form and a specific form distribution. A toner that has an excessively low average circularity may degrade the transferability and result in production of images with dust. An optical detection method can be used for measuring particle forms in which particle images are optically detected by a charge coupled device (CCD) camera while a suspension containing particles passes through an imaging detective portion having a plate form. The average circularity of the particle is determined by dividing the circumferential length of the circle having the area equal to a projected toner area with the circumferential length of the projected toner area. The average circularity of the toner particle is preferably from 0.90 to 1.00 to form high definition quality images with a suitable density. The average circularity can be measured by a flow particle image analyzer (FPIA-2000, manufactured by Sysmex Corporation). Specific measuring method is described later.

The weight average particle diameter (D4) of the present invention is preferably from 3 to 8 μm. The ratio (D4/Dn) of the weight average particle diameter (D4) to the number average particle diameter (Dn) is preferably not greater than 1.25 and more preferably from 1.10 to 1.25. Thus, the toner has a good heat resistance preservation property, the low temperature fixing property and anti-hot offset property and is excellent at gloss property especially when the toner is used in a color image photocopier. Furthermore, when a two component developer including the toner is used and replenished in a long period of time, the variance in the particle diameter of the toner in the developer is small and the developability of the toner is good and stable at repeated stirring in a developing unit over a long period of time. When the toner is used as a single component and replenished, the variance of the particle diameter of the toner is small and filming of the toner on a developing roller and fusion bonding of the toner onto a member, for example, a blade for regulating the thickness of the toner layer, hardly occur. Therefore, good and stable developability is obtained so that quality images can be produced when the developing unit is used (i.e., stirring) for an extended period of time.

In general, a toner having a small particle diameter is advantageous to obtain high definition and high quality images, but disadvantageous in transferability and cleaning properties. When a toner having a D4 that is too small is used in a two component developer, the toner tends to be fusion bonded to the surface of the carrier as stirring repeats in a long period of time and resultantly the charging ability of the carrier may degrade. When the toner is used as a single component developer, the toner easily forms filming on a developing roller and/or is fusion bonded to a member, for example, a blade for regulating the thickness of the toner layer. The same phenomena can be seen in the case of a toner including fine particles more than the case of the toner of the present invention.

To the contrary, when D4 of a toner is excessively large, it may be difficult to obtain high definition quality images and the particle diameter distribution of the toner may widely vary when a toner contained in a developing agent is replenished. The same is true when D4/Dn is too large. A D4/Dn that is excessively small may contribute to stabilization of toner particle behavior and uniformity in terms of the amount of charge but may cause insufficiency in terms of charging, which leads to deterioration of cleaning property.

The particle diameter of the particle size distribution of the toner of the present invention can be measured by using a COULER COUNTER TA-II connected to an interface manufactured by Nikkaki Bios Co., Ltd., and PC9801 personal computer manufactured by NEC Corporation, which outputs number distribution and volume distribution.

When the acid value of the toner of the present invention is taken into consideration in light of the low temperature fixing property and the anti-offset property, the acid value is preferred to be from 1 to 30 mgKOH/g to control the fixing property (e.g., the lowest temperature for fixing and the temperature at which offset starts to occur) thereof. When the acid value is too large, elongation and cross-bridge reaction of a modified polyester may not be sufficient, which leads to an adverse impact on the anti-offset property. When the acid value is too small, elongation and cross-bridge reaction of a modified polyester tends to be too quick, which causes a problem of manufacturing stability.

In the present invention, there is no specific limit to the selection of the organic solvent as long as the organic solvent can dissolve or disperse a toner composition. The organic solvent is preferred to be volatile and have a boiling point lower than 150° since it is easy to get removed. Specific examples thereof include toluene, xylene, benzene, carbon tetrachloride, methylene chloride, 1,2-dichloroethane, 1,1,2-trichloroethane, trichloroethylene, chloroform, monochlorobenzene, methyl acetate, ethyl acetate, methylethyl ketone, acetone and tetrahydrofuran. These can be used alone in combination. The content of the organic solvent is from 40 to 300 parts by weight, preferably from 60 to 140 parts by weight and more preferably from 80 to 120 parts by weight based on 100 parts by weight of a toner component.

In the present invention, suitable colorants include any known dyes and pigments.

Specific examples of such colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, QuinacridoneRed, PyrazoloneRed, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination.

The content of the colorant is preferably from 1 to 15% by weight, and more preferably from 3 to 10% by weight, based on the total weight of the toner.

Master batch pigments, which are prepared by combining a colorant with a resin, can be used as the colorant of the toner composition of the present invention. Specific examples of the resins for use in the master batch pigments or for use in combination with master batch pigments include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins, for example, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins can be used alone or in combination.

The master batch mentioned above is typically prepared by mixing and kneading a resin and a colorant upon application of high shear stress thereto. In this case, an organic solvent can be used to boost the interaction of the colorant with the resin. In addition, flushing methods in which an aqueous paste including a colorant is mixed with a resin solution of an organic solvent to transfer the colorant to the resin solution and then the aqueous liquid and organic solvent are separated to be removed can be preferably used because the resultant wet cake of the colorant can be used as it is. In this case, three-roll mills can be preferably used for kneading the mixture upon application of high shear stress thereto.

A release agent can be contained in the toner of the present invention in addition to a binding resin and a colorant.

Specific examples of the release agent include polyolef in waxes such as polyethylene waxes and polypropylene waxes; long chain hydrocarbons such as paraffin waxes and SAZOL waxes; waxes including a carbonyl group, etc. Among these waxes, the waxes including a carbonyl group are preferred. Specific examples of the waxes including a carbonyl group include polyalkane acid esters, for example, carnauba wax, montan waxes, trimethylolpropane tribehenate, pentaerythritol tetrabehenate, pentaerythritol diacetate dibehenate, glycerin tribehenate, and 1,18-octadecanediol distearate; polyalkanol esters, for example, trimellitic acid tristearyl, and distearyl maleate; polyalkylamide, for example, trimellitic acid tristearylamide; dialkyl ketone, for example, distearyl ketone, etc. Among these materials, polyalkane acid esters are preferred.

The release agent for use in the toner of the present invention preferably have a melting point of from 40 to 160° C., more preferably from 50 to 120° C., and even more preferably from 60 to 90° C. When the melting point of the release agent included in a toner is too low, the heat resistance preservation property of the toner tends to deteriorate. In contrast, when the melting point is too high, a cold offset tends to occur during fixing at a low temperature.

In addition, the release agent used in the toner of the present invention preferably has a melt viscosity of from 5 to 1,000 cps and more preferably from 10 to 1,000 cps at a temperature 20° C. higher than the melting point of the wax. When the melt viscosity is too high, the effect of improving the ant-hot offset property and low temperature fixability may be reduced.

The content of the release agent in the toner is from 0 to 40% by weight and preferably from 3 to 30% by weight based on the total weight of the toner.

A charge controlling agent may be included as a toner component of the present invention.

Specific examples of the charge controlling agent include known charge controlling agents, for example, Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc. Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LA-901, and LR-147 (boron complex), which are manufactured by Japan Carlit Co., Ltd.; copper phthalocyanine, perylene, quinacridone, azo pigments and polymers having a functional group, for example, a sulfonate group, a carboxyl group and a quaternary ammonium group.

The content of the charge controlling agent is determined depending on the kind of the binder resin used, whether or not an additive is added and toner manufacturing method (for example, dispersion method) used, and is not particularly limited. However, the content of the charge controlling agent is from 0.1 to 10 parts by weight, and preferably from 0.2 to 5 parts by weight, per 100 parts by weight of the binder resin included in the toner. When the content is too high, the toner tends to have too large chargeability, and thereby the electrostatic force of a developing roller increases and attracts the toner, resulting in deterioration of the fluidity of the toner and a decrease of the image density of toner images. The charge controlling agent can be dissolved or dispersed in an organic solvent after kneaded together with a master batch pigment and resin. The charge controlling agent can be dissolved and/or dispersed after the charge controlling agent is melted and kneaded with a master batch and a resin, can be directly added to an organic solvent when the toner component is dissolved or dispersed in the organic solvent, or can be fixed on the surface of toner particles after mother particles of the toner are made.

In the present invention, mother particles of toner can be used as toner. Also external additives can be added to mother particles to assist improving fluidity, developability and chargeability of a toner. Inorganic particulates can be used as the external additive. The primary particle diameter of the external additive is preferably from 5 nm to2 μm and more preferably from 5 to 500 nm. It is preferred that the specific surface area of such inorganic particulates measured by a BET method is from 20 to 500 $m^2/g$. The content of the external additive is preferably from 0.01 to 5% by weight, and more preferably from 0.01 to 2.0% by weight, based on the total weight of the toner.

Specific preferred examples of such inorganic particulates include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride.

In addition, polymeric particulates, for example, copolymers of styrene, esters of methacryic acid, and esters of acrylic acid, polycondensation polymerization resins and thermosetting resins, for example, silicone resins, benzoguanamine resins and nylon resins, which can be prepared by a soap-free emulsion polymerization method, a suspension polymerization method or a dispersion polymerization method, can also be used as the external additive.

Such additives can be subject to a surface treatment to improve hydrophobic property, thereby preventing deterioration of the fluidity and charging properties of a toner even in a high humid surrounding. Specific preferred examples of the surface preparation agents include silane coupling agents, silylation agents, silane coupling agents including a fluoroalkyl group, organic titanate coupling agents, aluminum coupling agents, silicone oil, modified silicone oils.

Specific preferred examples of cleaning property improving agents for use in removing developing agents remaining on an image bearing member and/or a primary transfer medium after transfer include fatty acids and their metal salts, for example, stearic acid, zinc stearate, and calcium stearate; and polymer particulates, for example, polymethyl methacrylate particulates and polystyrene particulates which are manufactured by a method, for example, a soap-free emulsion polymerization method. Such particulate polymers preferably have a relatively sharp particle diameter distribution and a volume average particle diameter of from 0.01 to 1 μm.

The toner of the present invention can be prepared by a typical pulverization method but is preferred to be manufactured in a circumstance free from the influence of shearing by melting and kneading and temperature variance by heating since the performance of the toner is most stable when the toner is manufactured in such a circumstance.

It is preferred to add resin particulates in advance to an aqueous medium for use in manufacturing the toner of the present invention. Water can be used alone or in combination with a water soluble solvent as the aqueous medium. Specific examples of such water soluble solvents include alcohols (for example, methanol, isopropanol and ethylene glycol), dimethylformamide, tetrahydrofuran, cellosolves (for example, methyl cellosolve) and lower ketones (for example, acetone and methyl ethyl ketone).

Mother particles of a toner are obtained by dispersing a solution or a liquid dispersion in which a composition containing a polymer (B) having a portion reactionable with an active hydrogen group is dissolved or dispersed in an organic solvent in an aqueous medium followed by reaction between the polymer (B) and a compound (A) having active hydrogen groups. A dispersion body containing the polymer (B) can be stably formed in an aqueous medium by, for example, a method in which the organic solvent in which the polymer (B) is dissolved or dispersed is added to the aqueous medium followed by shearing for dispersion. The polymer (B) and other toner components (hereinafter referred to as toner material), for example, a colorant, a colorant master batch, a releasing agent and a charge controlling agent, can be mixed when forming a dispersion body in an aqueous medium. It is preferred to mix the toner materials, dissolve or disperse the mixture in an organic solvent and add and disperse the mixture in an aqueous medium. In addition, it is possible to add toner materials after formation of particles. For example, it is possible to add a colorant by a known method after forming particles not containing the colorant.

There is no particular restriction for the dispersion method. Low speed shearing methods, high speed shearing methods, friction methods, high pressure jet methods, ultrasonic methods, etc., can preferably be used. Among these methods, high speed shearing methods are more preferred because particles having a particle diameter of from 2 to 20 μm can be easily prepared. When a high speed shearing type dispersion machine is used, there is no particular limit to the rotation speed thereof, but the rotation speed is typically from 1,000 to 30,000 rpm, and preferably from 5,000 to 20,000 rpm. The dispersion time is also not particularly limited, but is typically from 0.1 to 5 minutes for a batch production method. The temperature in the dispersion process is typically from 0 to 150° C. (under pressure), and preferably from 40 to 98° C. The dispersion process is preferably performed at a high temperature because the dispersion body containing the polymer (B) has a low viscosity at a high temperature so that dispersion can be easily performed.

In the present invention, the content of the aqueous medium is normally from 50 to 2,000 parts by weight and preferably from 100 to 1,000 parts by weight per 100 parts by weight of toner composition. When the content of the aqueous medium is too small, the toner composition tends not to disperse well and thereby toner particles having a desired particle diameter are difficult to obtain. When the content is too large, the manufacturing cost increases.

It is also possible to add a dispersing agent to an aqueous medium, which makes it possible to have a narrow particle size distribution of a dispersion body and improve the dispersion stability.

Specific examples of the dispersing agents include anionic dispersing agents, for example, alkylbenzene sulfonic acid salts, α-olefin sulfonic acid salts, and phosphoric acid salts; cationic dispersing agents, for example, amine salts (e.g., alkyl amine salts, aminoalcohol fatty acid derivatives, polyamine fatty acid derivatives and imidazoline), and quaternary ammonium salts (e. g., alkyltrimethyl ammonium salts, dialkyldimethyl ammonium salts, alkyldimethyl benzyl ammonium salts, pyridinium salts, alkyl isoquinolinium salts and benzethonium chloride); nonionic dispersing agents, for example, fatty acid amide derivatives, polyhydric alcohol derivatives; and ampholytic dispersing agents, for example, alanine, dodecyldi(aminoethyl)glycin, di)octylaminoethyle) glycin, and N-alkyl-N,N-dimethylammonium betaine.

A good dispersion can be prepared with an extremely small amount of a surface active agent having a fluoroalkyl group. Specific examples of the anionic surface active agents having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16) ethylphosphates, etc.

Specific examples of the marketed products of such surface active agents having a fluoroalkyl group include SURFLON® S-111, S-112 and S-113, which are manufactured by Asahi Glass Co., Ltd.; FRORARD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surface active agents having a fluoroalkyl group include primary, secondary and tertiary aliphatic amino acids, aliphatic quaternary ammonium salts (for example, perfluoroalkyl(C6-C10)sulfoneamidepropyltrimethyl ammonium salts), benzalkonium salts, benzetonium chloride, pyridinium salts, and imidazolinium salts.

Specific examples of commercially available products of these elements include SURFLON® S-121 (from Asahi Glass Co., Ltd.); FROPARD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

In addition, a water hardly soluble inorganic dispersing agents can be used. Specific examples thereof include tricalcium phosphate, calcium carbonate, titanium oxide, colloidal silica and hydroxyapatite.

Furthermore, it is possible to stably disperse toner components in an aqueous medium using a polymeric protection colloid. Specific examples of such protection colloids include polymers and copolymers prepared using monomers, for example, acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers, for example, polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds, for example, methyl cellulose, hydroxyethyl cellulose and hydroxypropyl cellulose, can also be used as the polymeric protective colloid.

When compounds, for example, calcium phosphate, which are soluble in an acid or alkali, are used as a dispersion stabilizer, it is possible to dissolve the compounds by adding an acid, for example, hydrochloric acid, followed by washing of the resultant particles with water, to remove the compounds from toner mother particles. In addition, a zymolytic method can be used to remove such compounds.

There is no problem in that a dispersing agent that is used remains on the surface of toner mother particles. However, it is preferred to wash and remove the dispersing agent after elongation and/or cross-linking reaction in terms of charging toner particles.

The time of elongation and/or cross-linking reaction is selected depending on the reactivity based on the combination of the structure of the portion reactive with active hydrogen groups in the polymer (B) and the compound (A) having active hydrogen groups. The time is from 10 minutes to 4 hours and preferably from 2 to 24 hours. The reaction temperature is from 0 to 150° C. and preferably from 40 to 98° C. Known catalysts can be optionally used.

To remove the organic solvent from the obtained dispersion body, there can be used a method in which the entire system is gradually heated to completely evaporate and remove the organic solvent in droplets. Alternatively, a drying method can be used in which the dispersing body is sprayed in a dry atmosphere to completely evaporate and remove not only the non-water soluble organic solvent in droplets to form toner mother particles but also the remaining dispersing agent. The dry atmosphere can be prepared by heating gases, for example, air, nitrogen, carbon dioxide and combustion gases. The temperature of the heated gases is preferred to be higher than the boiling point of the solvent having the highest boiling point among the solvents used in the dispersion. By using a drying apparatus, for example, a spray dryer, a belt dryer, a rotary kiln, the drying treatment can be completed in a short period of time.

When the thus prepared toner particles have a wide particle diameter distribution even after a washing treatment and a drying treatment, the toner particles can be subjected to a desired classification treatment so that the toner particles have a desired particle diameter distribution.

The classification operation can be performed in a dispersion liquid using a cyclone, a decanter, or a method utilizing centrifuge to remove fine particles therefrom. It is possible to classify dried toner powder particles. Considering efficiency, it is preferred to subject the liquid including the particles to the classification treatment. The toner particles having an undesired particle diameter can be returned to the kneading process for reuse regardless of whether the toner particles are in a wet condition.

It is preferred to remove the dispersing agent from the liquid dispersion as much as possible. The dispersing agent can be removed at the same time of the classification treatment.

To obtain the toner of the present invention, the thus prepared toner mother particles after drying can be mixed with other particles of, for example, release agents, charge controlling agents, fluidizing agents and colorants. Such particles can be fixed on the toner particles by applying a mechanical impact thereto to integrate the particles with toner particles. Thus, the other particles can be prevented from being detached from the toner particles. Specific examples of such mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

The toner of the present invention can be used for a two-component developer in which the toner is mixed with a carrier. The weight ratio (T/C) of the toner (T) to the carrier (C) is preferably from 1/100 to 10/100.

Suitable carriers for use in a two component developer include known carrier materials, for example, iron powders, ferrite powders and magnetite powders which have a particle diameter of from about 20 to about 200 μm. The surface of the carriers can be coated by a resin. Specific examples of such resins to be coated on the carriers include amino resins, for example, urea-formaldehyde resins, melamine resins, benzoguanamine resins, urea resins, and polyamide resins, and epoxy resins. In addition, there are also included vinyl or vinylidene resins, for example, acrylic resins, polymethylmethacrylate resins, polyacrylonitirile resins, polyvinyl acetate resins, polyvinyl alcohol resins, polyvinyl butyral resins polystyrene resins, styrene-acrylic copolymers, halogenated olefin resins, forexample, polyvinyl chloride resins, polyester resins, for example, polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, the electroconductive powder can be optionally included in the resin. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic developer or a one-component non-magnetic developer.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention is furthermore described with reference to the Examples but not limited thereto.

Example 1

The following components are placed in a container equipped with a stirrer and a thermometer and agitated for 15 minutes at a revolution of 400 rpm.

| | |
|---|---|
| Water | 683 parts |
| Sodium salt of sulfate of an adduct of methacrylic acid with ethyleneoxide (EREMINOR RS-30 from Sanyo Chemical Industries Ltd.) | 11 parts |
| Styrene | 83 parts |
| Methacrylic acid | 83 parts |
| butylacrylate | 110 parts |
| Ammonium persulfate | 1 part |

As a result, a white emulsion is obtained. Thereafter, the emulsion is heated to 75° C. to conduct a reaction for 5 hours. Then, 30 parts of a 1 weight % aqueous solution of ammonium persulfate are added to the emulsion and the mixture is further aged for 5 hours at 75° C. Resultantly, an aqueous dispersion (Particulate dispersion 1) of a vinyl resin (i.e., a copolymer of styrene, methacrylic acid, butylacrylate and sodium salt of a sulfate of an adduct of methacrylic acid with ethyleneoxide) is prepared. The volume average particle diameter of Particulate dispersion 1 is measured by a laser scattering particle size distribution analyzer LA-920, manufactured by Horiba, Ltd. and is 105 nm. The resin portion is isolated by drying a part of Particulate dispersion 1. The isolated resin has a glass transition temperature (Tg) of 59° C. and a weight average molecular weight of 150,000.

Eighty three (83) parts of the particle dispersion 1 are mixed with the following components obtain a milky white liquid, which is defined as Aqueous phase 1:

| | |
|---|---|
| Water | 990 parts |
| 48.5% aqueous solution of sodium dodecyldiphenyletherdisulfonate (EREMINOR MON-7 from Sanyo Chemical Industries, Ltd.) | 37 parts |
| Ethyl acetate | 90 parts |

The following components are contained in a reaction container equipped with a condenser, stirrer and a nitrogen introducing tube to conduct a reaction at 230° C. for 8 hours followed by another reaction with a reduced pressure of 10 to 15 mmHg for 5 hours:

| | |
|---|---|
| Adduct of bisphenol A with 2 mol of ethylene oxide | 229 parts |
| Bisphenol A with 3 mole of propylene oxide | 529 parts |
| Terephthalic acid | 208 parts |
| Adipic acid | 46 parts |
| Dibutyl tin oxide | 2 parts |

Forty four (44) parts of trimellitic anhydride is added in the container to conduct a reaction at 180° C. under normal pressure for 2 hours and obtain Low molecular weight polyester 1, which has a number average molecular weight of 2,500, a weight average molecular weight of 6,700, a glass transition temperature of 43° C. and an acid value of 25 mgKOH/g.

The following components are contained in a container equipped with a condenser, a stirrer and a nitrogen introducing tube to conduct a reaction at 230° C. at normal pressure for 8 hours followed by another reaction for 5 hours with a reduced pressure of 10 to 15 mmHg to obtain Intermediate polyester 1:

| | |
|---|---|
| Propylene glycol | 463 parts |
| Terephthalic acid | 657 parts |
| Trimellitic anhydrate | 96 parts |
| Titan tetra buthoxide | 2 parts |

Intermediate polyester 1 has a weight average molecular weight of 28,000, a glass transition temperature of 36° C., an acid value of 0.5 mgKOH/g and a hydroxyl value of 16.5 mgKOH/g.

One thousand two hundred (1200) parts of water, 540 parts of carbon black (Printex 35 from Degussa AG) which has a dibutyl phthalate (DBP) oil absorption of 42 ml/100 mg and has a PH of 9.5, and 1200 parts of a polyester resin are added and mixed in a Henshel mixer (manufactured by Mitsui Mining Company, Limited). This mixture is kneaded for 30 minutes at 150° C. using a two-roll mill followed by rolling and cooling. Thereafter, the kneaded mixture is pulverized to obtain Master batch 1.

The following is placed and mixed in a reaction container equipped with a stirrer and a thermometer:

| | |
|---|---|
| Low molecular weight polyester 1 | 378 parts |
| Carnauba wax | 110 parts |
| Metal complex of salicylic acid (CCA) (E-84 from Orient Chemical Industries Co., Ltd.) | 22 parts |
| Ethyl acetate | 947 parts |

The mixture is agitated, heated to 80° C., and kept at 80° C. for 5 hours and then cooled down to 30° C. in 1 hour. Then, 500 parts of Master batch 1 and 500 parts of ethyl acetate are added to the reaction container and mixed for 1 hour to obtain Liquid material 1.

Then, 1,324 parts of Liquid material 1 are transferred to a container and dispersed using a bead mill (ULTRAVISCOMILL from AIMEX) under the following conditions to disperse carbon black and wax:

Liquid feeding speed: 1 kg/hr,

Disc rotation speed: 6 m/sec,

Diameter of zirconia beads: 0.5 mm,

Filling factor: 80% by volume, and

Repeat number of dispersion treatment: 3 times.

Then, 1,324 parts of a 65% ethyl acetate solution of Low molecular weight polyester 1 are added thereto, and the mixture is dispersed by a bead mill under the conditions mentioned above except that the repeat number of the dispersion treatment is changed to 1 time to obtain Liquid dispersion 1 of pigment and wax, which has a solid portion density of 50% under the measuring conditions of 130° C. for 30 minutes.

The following components are contained in a container equipped with a condenser, a stirrer and a nitrogen introducing tube conduct a reaction at 100° C. for 3 hours:

| | |
|---|---|
| Intermediate polyester 1 | 250 parts |
| Trimethylol propane | 0.25 parts |
| Isophorone diisocyanate | 1.4 parts |
| Bismuth based catalyst (NEOSTANN U-600, manufactured by Nitto Kasei Co., Ltd.) | 0.5 parts |
| Ethyl acetate | 250 parts |

Furthermore, 16.2 parts of isophorone diisocyanate is added thereto at 100° C. followed by a 3-hour reaction to obtain Prepolymer 1, which has an isocyanate weight % of 0.57%. The hydroxyl group value of the mixture of 250 parts of Intermediate polyester 1 and 0.25 parts of trimethylol propane is 17.7 mgKOH/g.

The following components are contained in a container and mixed for 1 minute using a TK HOMOMIXER (manufactured by Tokushu Kika Kogyo Co., Ltd.) at a revolution of 5,000 rpm.

| | |
|---|---|
| Liquid dispersion 1 of pigment and wax | 749 parts |
| Prepolymer 1 | 100 parts |
| Isophorone diamine | 1.1 parts |

Then, 1200 parts of the aqueous phase 1 are added thereto followed by mixing for 20 minutes at a revolution of 13,000 rpm using a TK HOMOMIXER to prepare Emulsion slurry 1. Emulsion slurry 1 is placed in a container equipped with a stirrer and a thermometer to remove the solvents at 30° C. for 8 hours. Thereafter, the resultant is aged at 45° C. for 4 hours to obtain Slurry dispersion 1, which has a volume average particle diameter of 5.21 μm and a number average particle diameter of 4.57 μm (measured by Coulter Multisizer II, manufactured by Beckman Coulter Inc.).

One hundred (100) parts of the slurry dispersion 1 are filtered under a reduced pressure followed by the operations below.

(1) 100 parts of deionized water are added to the thus prepared filtered cake and the resultant is mixed for 10 minutes at a rotation number of 12,000 rpm by a TK HOMOMIXER and then filtered;

(2) 100 parts of distilled water are added to the filtered cake prepared in (1) and the resultant is mixed for 30 minutes at a rotation number of 12,000 rpm by a TK HOMOMIXER and then filtered under a reduced pressure;

(3) 100 parts of a 10% hydrochloric acid are added to the filtered cake prepared in (2) and the resultant is mixed for 10 minutes at a rotation number of 12,000 rpm by a TK HOMOMIXER and then filtered; and (4) 300 parts of deionized water are added to the filtered cake prepared in (3) and the resultant is mixed for 10 minutes at a rotation number of 12,000 rpm by a TK HOMOMIXER and then filtered. This washing is repeated twice to obtain Filtered cake 1. Filtered cake 1 is dried at 45° C. for 48 hours using a circulating drier. The obtained dried cake is filtered using a screen having a mesh of 75 μm to obtain a toner. The characteristics of this toner are shown in Table 1.

Example 2

The following components are contained in a container equipped with a condenser, a stirrer and a nitrogen introducing tube to conduct a reaction at 100° C. for 3 hours:

| | |
|---|---|
| Intermediate polyester 1 | 250 parts |
| Trimethylol propane | 0.5 parts |
| Isophorone diisocyanate | 2.7 parts |
| Bismuth based catalyst (NEOSTANN U-600, manufactured by Nitto Kasei Co., Ltd.) | 0.5 parts |
| Ethyl acetate | 250 parts |

Furthermore, 14.3 parts of isophorone diisocyanate is added thereto followed by a 3-hour reaction at 100° C. to obtain Prepolymer 2, which has an isocyanate weight % of 0.52%. The hydroxyl group value of the mixture of 250 parts of Intermediate polyester 1 and 0.5 parts of trimethylol propane is 19.0 mgKOH/g.

The toner of Example 2 is prepared in the same manner as in Example 1 except that Prepolymer 2 is used instead of Prepolymer 1 and the addition content of isophorone dimaine is changed from 1.1 parts to 1.0 part.

Example 3

The following components are contained in a container equipped with a condenser, a stirrer and a nitrogen introducing tube to conduct a reaction at 100° C. for 3 hours:

| | |
|---|---|
| Intermediate polyester 1 | 250 parts |
| Pentaerythritol | 0.25 parts |
| Isophorone diisocyanate | 1.4 parts |
| Bismuth based catalyst (NEOSTANN U-600, manufactured by Nitto Kasei Co., Ltd.) | 0.5 parts |
| Ethyl acetate | 250 parts |

Furthermore, 16.3 parts of isophorone diisocyanate is added thereto followed by a 3-hour reaction at 100° C. to obtain Prepolymer 3, which has an isocyanate weight % of 0.55%. The hydroxyl group value of the mixture of 250 parts of the intermediate polyester 1 and 0.25 parts of pentaerythritol is 18.1 mgKOH/g.

The toner of Example 3 is prepared in the same manner as in Example 1 except that Prepolymer 3 is used instead of Prepolymer 1.

Example 4

The following components are contained in a container equipped with a condenser, a stirrer and a nitrogen introducing tube to conduct a reaction at 100° C. for 3 hours:

| | |
|---|---|
| Intermediate polyester 1 | 250 parts |
| Pentaerythritol | 0.5 parts |
| Isophorone diisocyanate | 2.7 parts |
| Bismuth based catalyst (NEOSTANN U-600, manufactured by Nitto Kasei Co., Ltd.) | 0.5 parts |
| Ethyl acetate | 250 parts |

Furthermore, 14.6 parts of isophorone diisocyanate is added thereto followed by a 3-hour reaction at 100° C. to obtain Prepolymer 4, which has an isocyanate weight % of 0.45%. The hydroxyl group value of the mixture of 250 parts of Intermediate polyester 1 and 0.5 parts of pentaerythritol is 19.8 mgKOH/g.

The toner of Example 4 is prepared in the same manner as in Example 1 except that Prepolymer 4 is used instead of Prepolymer 1 and the addition content of isophorone dimaine is changed from 1.1 parts to 0.9 parts.

Example 5

The following components are contained in a container equipped with a condenser, a stirrer and a nitrogen introducing tube to conduct a reaction at 230° C. at normal pressure for 6 hours followed by another reaction for 4 hours with a reduced pressure of 10 to 15 mmHg to obtain Intermediate polyester 2:

| | |
|---|---|
| Propylene glycol | 463 parts |
| Terephthalic acid | 657 parts |
| Trimellitic anhydrate | 196 parts |
| Titan tetra buthoxide | 2 parts |

Intermediate polyester 2 has a weight average molecular weight of 19,000, a glass transition temperature of 34° C., an acid value of 0.5 mgKOH/g and a hydroxyl value of 22.6 mgKOH/g.

Next, the following components are contained in a container equipped with a condenser, a stirrer and a nitrogen introducing tube to conduct a reaction at 100° C. for 3 hours:

| | |
|---|---|
| Intermediate polyester 2 | 250 parts |
| Trimethyol propane | 0.15 parts |
| Isophorone diisocyanate | 0.8 parts |
| Bismuth based catalyst (NEOSTANN U-600, manufactured by Nitto Kasei Co., Ltd.) | 0.5 parts |
| Ethyl acetate | 250 parts |

Furthermore, 23.6 parts of isophorone diisocyanate is added thereto followed by a 3-hour reaction at 100° C. to obtain Prepolymer 5, which has an isocyanate weight % of 0.82%. The hydroxyl group value of the mixture of 250 parts of Intermediate polyester 2 and 0.15 parts of trimethylol propane is 23.6 mgKOH/g.

The toner of Example 5 is prepared in the same manner as in Example 1 except that Prepolymer 5 is used instead of Prepolymer 1 and the addition content of isophorone dimaine is changed from 1.1 parts to 1.7 parts.

Example 6

The following components are contained in a container equipped with a condenser, a stirrer and a nitrogen introducing tube to conduct a reaction at 230° C. at normal pressure for 5 hours followed by another reaction for 3 hours with a reduced pressure of 10 to 15 mmHg to obtain Intermediate polyester 3:

| | |
|---|---|
| Propylene glycol | 463 parts |
| Terephthalic acid | 657 parts |
| Trimellitic anhydrate | 196 parts |
| Titan tetra buthoxide | 2 parts |

Intermediate polyester 3 has a weight average molecular weight of 11,000, a glass transition temperature of 33° C., an acid value of 0.5 mgKOH/g and a hydroxyl value of 28.0 mgKOH/g.

Next, the following components are contained in a container equipped with a condenser, a stirrer and a nitrogen introducing tube to conduct a reaction at 100° C. for 3 hours:

| | |
|---|---|
| Intermediate polyester 3 | 250 parts |
| Trimethylol propane | 0.25 parts |
| Isophorone diisocyanate | 1.4 parts |
| Bismuth based catalyst (NEOSTANN U-600, manufactured by Nitto Kasei Co., Ltd.) | 0.5 parts |
| Ethyl acetate | 250 parts |

Furthermore, 28.6 parts of isophorone diisocyanate is added thereto followed by a 3-hour reaction at 100° C. to obtain Prepolymer 6, which has an isocyanate weight % of 1.05%. The hydroxyl group value of the mixture of 250 parts of Intermediate polyester 3 and 0.25 parts of trimethylol propane is 29.2 mgKOH/g.

The toner of Example 6 is prepared in the same manner as in Example 1 except that Prepolymer 6 is used instead of Prepolymer 1 and the addition content of isophorone dimaine is changed from 1.1 parts to 2.2 parts.

Example 7

The following components are contained in a container equipped with a condenser, a stirrer and a nitrogen introducing tube to conduct a reaction at 100° C. for 3 hours:

| | |
|---|---|
| Intermediate polyester 2 | 250 parts |
| Pentaerythritol | 1.5 parts |
| Isophorone diisocyanate | 8.2 parts |
| Bismuth based catalyst (NEOSTANN, U-600, manufactured by Nitto Kasei Co., Ltd.) | 0.5 parts |
| Ethyl acetate | 250 parts |

Furthermore, 13.8 parts of isophorone diisocyanate is added thereto followed by a 3-hour reaction at 100° C. to obtain Prepolymer 7, which has an isocyanate weight % of 0.67%. The hydroxyl group value of the mixture of 250 parts of Intermediate polyester 1 and 1.5 parts of pentaerythritol is 32.3,mgKOH/g.

The toner of Example 7 is prepared in the same manner as in Example 1 except that Prepolymer 7 is used instead of Prepolymer 1 and the addition content of isophorone dimaine is changed from 1.1 parts to 1.4 parts.

Comparative Example 1

The following components are contained in a container equipped with a condenser, a stirrer and a nitrogen introducing tube to conduct a reaction at 230° C. at normal pressure for 8 hours followed by another reaction for 5 hours with a reduced pressure of 10 to 15 mmHg to obtain Intermediate polyester 4:

| | |
|---|---|
| Adduct of bisphenol A with 2 mole of ethylene oxide | 682 parts |
| Adduct of bisphenol A with 2 mole of propylene oxide | 81 parts |
| Terephthalic acid | 283 parts |
| Trimellitic anhydrate | 22 parts |
| Dibutyl tin oxide | 2 parts |

Intermediate polyester 4 has a number average molecular weight of 2,100, a weight average molecular weight of 9,500, a glass transition temperature of 55° C., an acid value of 0.5 mgKOH/g and a hydroxyl value of 51 mgKOH/g.

Next, the following components are contained in a container equipped with a condenser, a stirrer and a nitrogen introducing tube to conduct a reaction at 100° C. for 5 hours to obtain Prepolymer 8:

| | |
|---|---|
| Intermediate polyester 4 | 410 parts |
| Isophorone diisocyanate | 89 parts |
| Ethyl acetate | 500 parts |

Prepolymer 8 has an isolated isocyanate weight % of 1.53%.

The toner of Example 8 is prepared in the same manner as in Example 1 except that Prepolymer 8 is used instead of Prepolymer 1 and the addition content of isophorone dimaine is changed from 1.1 parts to 3.0 parts.

Evaluations

Measuring NCO %

NCO % is measured according to the method described in JIS K1603.

Measuring Method of Acid Value

Acid value is measured according to the method described in JIS K0070. When a sample is not dissolved, solvents, for example, dioxane and tetrahydrofuran (THF), are used.

Measuring Method of Hydroxyl Value

Hydroxyl value is measured according to the method described in JIS K0070. When a sample is not dissolved, solvents, for example, dioxane and tetrahydrofuran (THF), are used.

Particle Diameter

Particle diameter of a toner is measured by using COULTER COUNTER TAII manufactured by Beckman Coulter, Inc. with an aperture of 100 μm. As a device for measuring the particle size distribution of toner particles by Coulter Counter method, COULTER COUNTER TAII and COULTER MULTISIZER II, both manufactured by Beckman Coulter, Inc., can be used. The measuring method is:

Add 0.1 to 5 ml of a surface active agent, preferably a salt of an alkyl benzene sulfonate, as a dispersant to 50 to 100 ml of an electrolytic aqueous solution, which is about 1% NaCl aqueous solution prepared by using primary NaCl. For example, ISOTON-II (manufactured by Beckman Coulter, Inc.) can be used; add 1 to 10 mg of a measuring sample to the electrolytic aqueous solution; Conduct dispersion treatment for the electrolytic aqueous solution in which the measuring sample is suspended for 1 to 3 minutes by a supersonic dispersion device; Measure the volume and the number of the toner by the measuring device mentioned above with an aperture of 100 μm; and calculate the volume distribution and the number distribution. The weight average particle diameter (D4) and the number average particle diameter (Dn) of the toner can be obtained based on the obtained distributions.

The whole range is a particle diameter of from 2.00 to not greater than 40.30 μm and the number of the channels is 13. Each channel is: from 2.00 to not greater than 2.52 μm; from 2.52 to not greater than 3.17 μm; from 3.17 to not greater than 4.00 μm; from 4.00 to not greater than 5.04 μm; from 5.04 to not greater than 6.35 μm; from 6.35 to not greater than 8.00 μm; from 8.00 to not greater than 10.08 μm; from 10.08 to not greater than 12.70 μm; from 12.70 to not greater than 16.00 μm, from 16.00 to not greater than 20.20 μm; from 20.20 to not greater than 25.40 μm; from 25.40 to not greater than 32.00 μm; and from 32.00 to not greater than 40.30 μm.

Weight Average Molecular Weight

The weight average particle diameter of a resin is measured by gel permeation chromatography (GPC) under the following conditions.

Device: GPC-150C (manufactured by Waters Corporation)
Column: KF801-807 (Showdex)
Temperature: 40° C.
Solvent: Tetrahydrofuran (THF)
Current speed: 1.0 ml/min.
Density of sample: 0.05 to 0.6 weight %
Amount of poured sample: 0.1 ml The weight average molecular weight of a resin is calculated from the molecular distribution measured under the condition mentioned above by using the molecular weight calibration curve made based on monodispersity polystyrene standard sample. When an NCO end modified polyester is measured for GPC, dibutyl amine being three time equivalent of NCO is added to seal the NCO end before measuring.

Average Circularity

Average circularity of a toner can be measured by using a flow particle image analyzer (FPIA-1000, manufactured by Sysmex Corporation). A specific method is: Add 0.1 to 0.5 ml of a surface active agent, preferably, alkylbenzene sulfonate salt, in 100 to 150 ml of water in a container from which impurity has been removed in advance; Add 0.1 to 0.5 g of a sample material thereto; Disperse the suspension, in which the sample material is dispersed, by a supersonic dispersing device for 1 to 3 minutes; and measure the form and distribution of the toner by the device mentioned above while the density of the liquid dispersion is presumed to be 3,000 to 10,000 particles/μl.

Glass Transition Temperature Tg

The method of measuring Tg is briefed as follows using TG-DSC system TAS-100 (manufactured by Rigaku Corporation) as a measuring device:

Place about 10 mg of a sample in an aluminum sample container; place the container on the holder unit and set it in an electric furnace; Heat the container from room temperature to 150° C. at a temperature raising ratio of 10° C./min.; Let the container stand for 10 minutes down to room temperature; Subsequent to letting it stand for another 10 minutes, heat the container again to 150° C. at a temperature raising ratio of 10° C./min in a nitrogen atmosphere for DSC measurement; and calculate Tg from the intersection of the tangent of the endothermic curve around TG and the base line using the analysis system in TAS-100 system.

Evaluation Method

Heat Resistance Preservation Property

Heat resistance preservation property of toner is evaluated in the following manner: Subsequent to reservation of toner at 50° C. for 8 hours, filter the toner by a screen having 42 mesh for 2 minutes; and measure the ratio of toner remaining on the screen to evaluate the heat resistance preservation property. The remaining ratio is small for a toner having a good heat resistance preservation property. The heat resistance preservation property is scaled in 4 ranks: B (for bad): not less than 30%; F (for fair): from 20 to less than 30%; G (for good): from 10 to less than 20%; E (for excellent): less than 10%.

Fixing Property

A solid toner image is developed on plain paper, thick paper, i.e., transfer paper type 6200 (manufactured by Ricoh Co., Ltd.) and photocopy printing paper <135>(manufactured by NBS Ricoh Co., Ltd.) using imagio Neo 450 (manufactured by Ricoh. Co., Ltd.) in such a manner that the toner is developed in 0.9 to 1.0 mg/cm$^2$. The fixing belt is adjusted such that the temperature thereof can vary. The upper limit temperature below which offset occurs for plain paper and the lower limit temperature below which the toner is not fixed for thick paper are measured. The lower limit temperature is determined as the fixing roll temperature below which the remaining ratio of the image density is less than 70% after the fixing image is rubbed by a pad.

Charging Property (1) 15 second stirring

One hundred (100) parts of silicone resin coated ferrite carrier having an average particle diameter of 50 μm and 4 parts of the toner are placed in a stainless pot such that the carrier and the toner occupy 30% of the volume of the pot. Subsequent to stirring at 100 rpm for 15 seconds, the charging amount is measured by a blow-off method.

(2) 10 minute stirring

The charging amount is measured in the same manner as in (1) except that the stirring time is changed to 10 minutes.

The results are shown in table 1.

TABLE 1

| | Example 1 | Example 2 | Example 3 | Example 4 | Example 5 | Example 6 | Example 7 | Comparative Example 1 |
|---|---|---|---|---|---|---|---|---|
| Weight average article diameter (D4) (μm) | 5.21 | 5.47 | 5.37 | 5.28 | 5.16 | 5.51 | 5.16 | 5.31 |

TABLE 1-continued

| | | Example 1 | Example 2 | Example 3 | Example 4 | Example 5 | Example 6 | Example 7 | Comparative Example 1 |
|---|---|---|---|---|---|---|---|---|---|
| Number average article diameter (Dn) (μm) | | 4.57 | 4.77 | 4.71 | 4.65 | 4.51 | 4.81 | 4.47 | 4.67 |
| D4/Dn | | 1.14 | 1.15 | 1.14 | 1.14 | 1.14 | 1.15 | 1.15 | 1.14 |
| Average Circularity | | 0.976 | 0.971 | 0.977 | 0.977 | 0.981 | 0.972 | 0.970 | 0.972 |
| Glass transition temperature (° C.) | | 46.2 | 46.5 | 46.6 | 47.1 | 46.2 | 47.5 | 47.6 | 47.6 |
| Acid value (mgKOH/g) | | 18.2 | 18.1 | 18.3 | 18.2 | 18.4 | 18.3 | 18.1 | 18.1 |
| Heat resistance preservation property | | G | G | G | G | G | G | G | G |
| Charging property | 15 sec (μC/g) | −19.5 | −20.4 | −19.8 | −20.3 | −19.1 | −18.5 | −19.1 | −20.6 |
| | 10 min (μC/g) | −22.1 | −21.9 | −21.9 | −22.2 | −21.6 | −21.1 | −21.1 | −22.6 |
| Fixing property | Lower limit temperature (° C.) | 120 | 120 | 120 | 120 | 125 | 135 | 135 | 145 |
| | Upper limit temperature (° C.) | 200 | 200 | 200 | 200 | 200 | 175 | 180 | 195 |

This document claims priority and contains subject matter related to Japanese Patent Application No. 2006-075645, filed on Mar. 17, 2006, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising a toner particle manufactured by a method, comprising:

dispersing an organic solvent in which a component comprising a polymer having a portion that is reactive with active hydrogen of an active hydrogen containing group is dispersed or dissolved in an aqueous medium; and reacting the polymer with a compound having at least one active hydrogen-containing group, wherein the polymer is prepared by reacting an aliphatic polyol, a polyester resin and a diisocyanate compound and has an isocyanate group on at least one end of the polymer.

2. The toner according to claim 1, wherein the number of carbon atoms in a main chain of the aliphatic polyol is 3 to 10.

3. The toner according to claim 1, wherein the hydroxyl group value of a mixture of the aliphatic polyol and the polyester resin is 15 to 30 mgKOH/g.

4. The toner according to claim 1, wherein the hydroxyl group value of the polyester resin is 14 to 26 mgKOH/g.

5. The toner according to claim 1, wherein said particle has a glass transition temperature of 40 to 70° C.

6. The toner according to claim 1, wherein said particle has a weight average particle diameter of 3 to 8 μm.

7. The toner according to claim 1, wherein said particle has a ratio of a weight average particle diameter to a number average particle diameter of 1.00 to 1.25.

8. The toner according to claim 1, wherein said particle has an average circularity of 0.90 to 1.00.

9. The toner according to claim 1, wherein said particle has an acid value of 1 to 30 mgKOH/g.

10. The toner according to claim 1, wherein the alcohol and the carboxylic acid are mixed in amounts so as to have an equivalence ratio ([OH])/[COOH]) ranging from 1 to 2.

11. The toner according to claim 1, wherein, in the synthesis of a prepolymer having an isocyanate group at its terminus, the equivalence ratio of isocyanate group to hydroxyl group [OH] in the prepolymer ranges from 2 to 4.

* * * * *